US006622314B1

(12) United States Patent
Kim et al.

(10) Patent No.: US 6,622,314 B1
(45) Date of Patent: Sep. 23, 2003

(54) COUPLING APPARATUS FOR HELMET SHIELD

(76) Inventors: Young-Il Kim, #355-302 Toegye Apt., Geumjung-dong, Gunpo-si, Kyunggi-do (KR); Kwang-Moon Choi, #931-905 Taeyoung Apt., 969-1 Youngtong-dong, Paldal-gu, Suwon-si, Kyunggi-do (KR)

( * ) Notice: Subject to any disclaimer, the term of this patent is extended or adjusted under 35 U.S.C. 154(b) by 0 days.

(21) Appl. No.: 10/225,443

(22) Filed: Aug. 21, 2002

(30) Foreign Application Priority Data

May 31, 2002 (KR) ..... 2002-30594

(51) Int. Cl.[7] ..... A42B 1/08
(52) U.S. Cl. ..... 2/424
(58) Field of Search ..... 2/424, 425, 422, 2/410, 10, 12

(56) References Cited

U.S. PATENT DOCUMENTS 6,253,386 B1 * 7/2001 Gafforio ..... 2/424
6,260,213 B1 * 7/2001 Eom et al. ..... 2/424

FOREIGN PATENT DOCUMENTS

JP 6-57510 A * 3/1994 ..... 2/424

* cited by examiner

*Primary Examiner*—Rodney M. Lindsey

(57) ABSTRACT

A coupling apparatus for a helmet shield includes a helmet and a shield that includes a left and right protruded inner portion, a curved rim protrusion, a cam shaped shaft portion having an engaging shaft flange at both sides of the rim protrusion and a guide pin shaft. A coupling apparatus includes a movable shaft member, base member and movable shaft member spring that is assembled to the back surface of the base member. The movable shaft member spring includes one end engaged to a spring engaging ring of the movable shaft member and the other end supported by the base member for thereby returning the movable shaft member, wherein the cam shaped shaft portion of the shield is rotatable in the movable shaft member, and the movable shaft member is slide-movable in the concave portion of the base member in a forward and backward direction.

10 Claims, 19 Drawing Sheets

【Fig. 1】
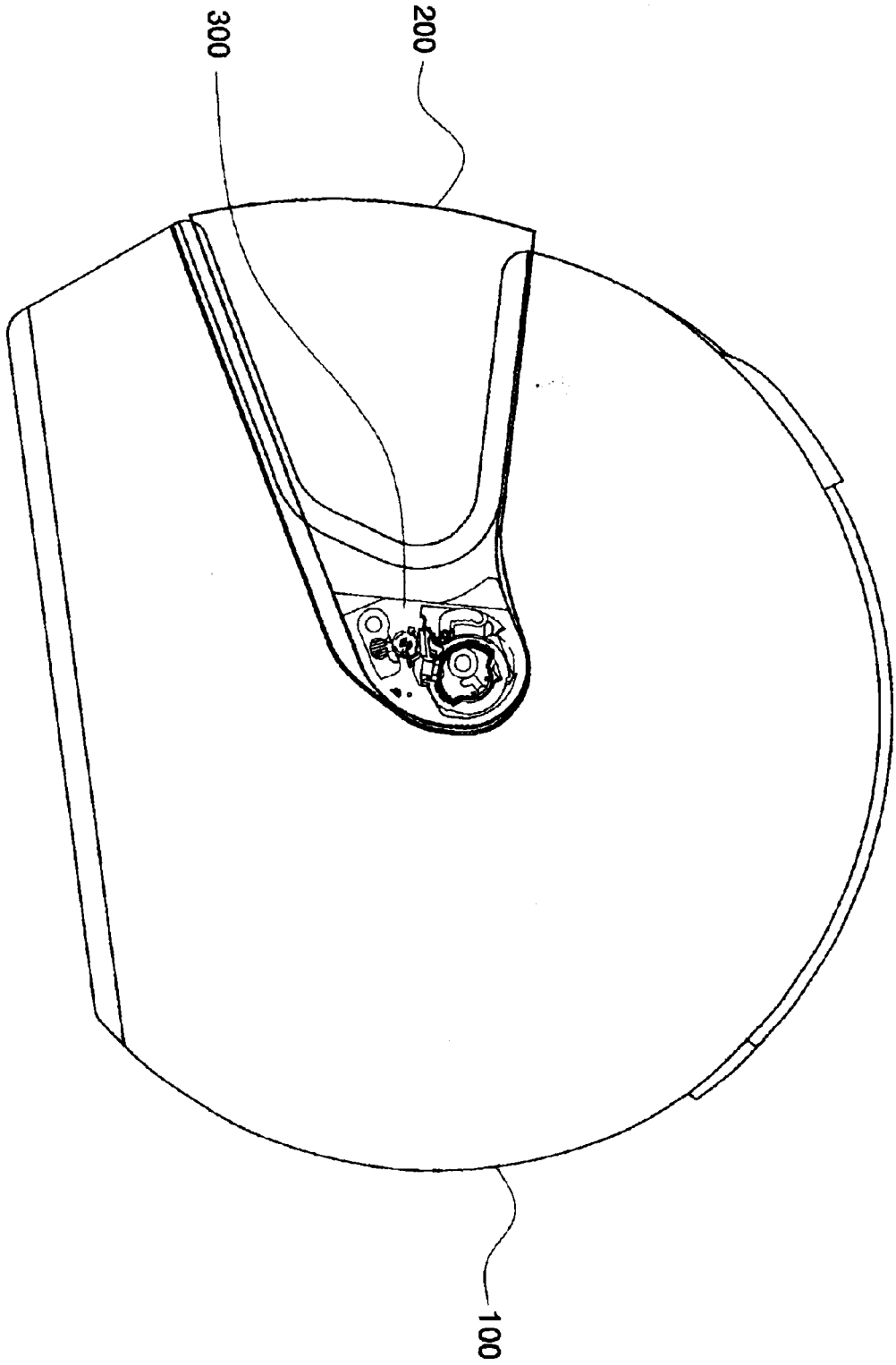

【Fig. 2】
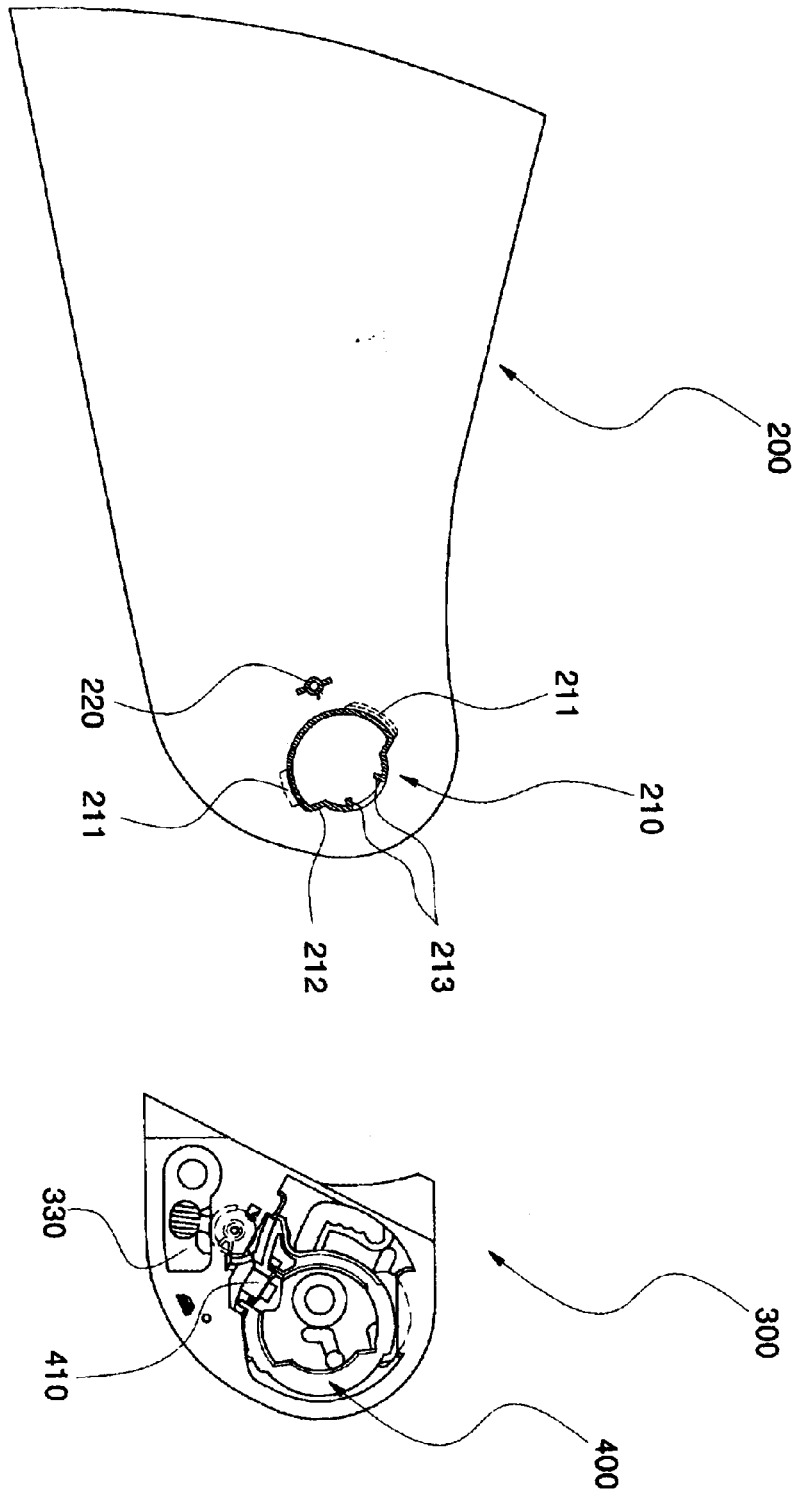

【Fig.3】
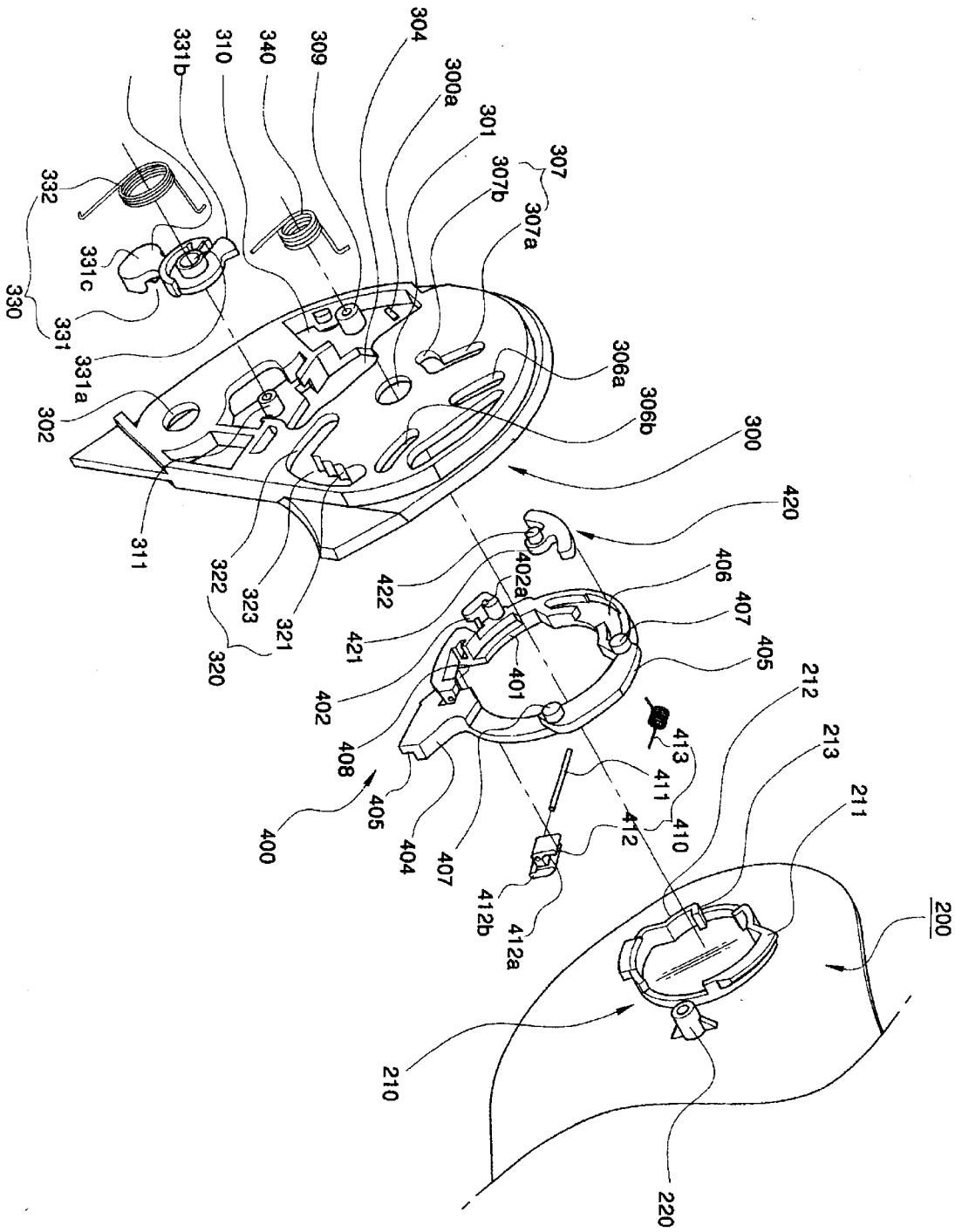

【Fig.4】
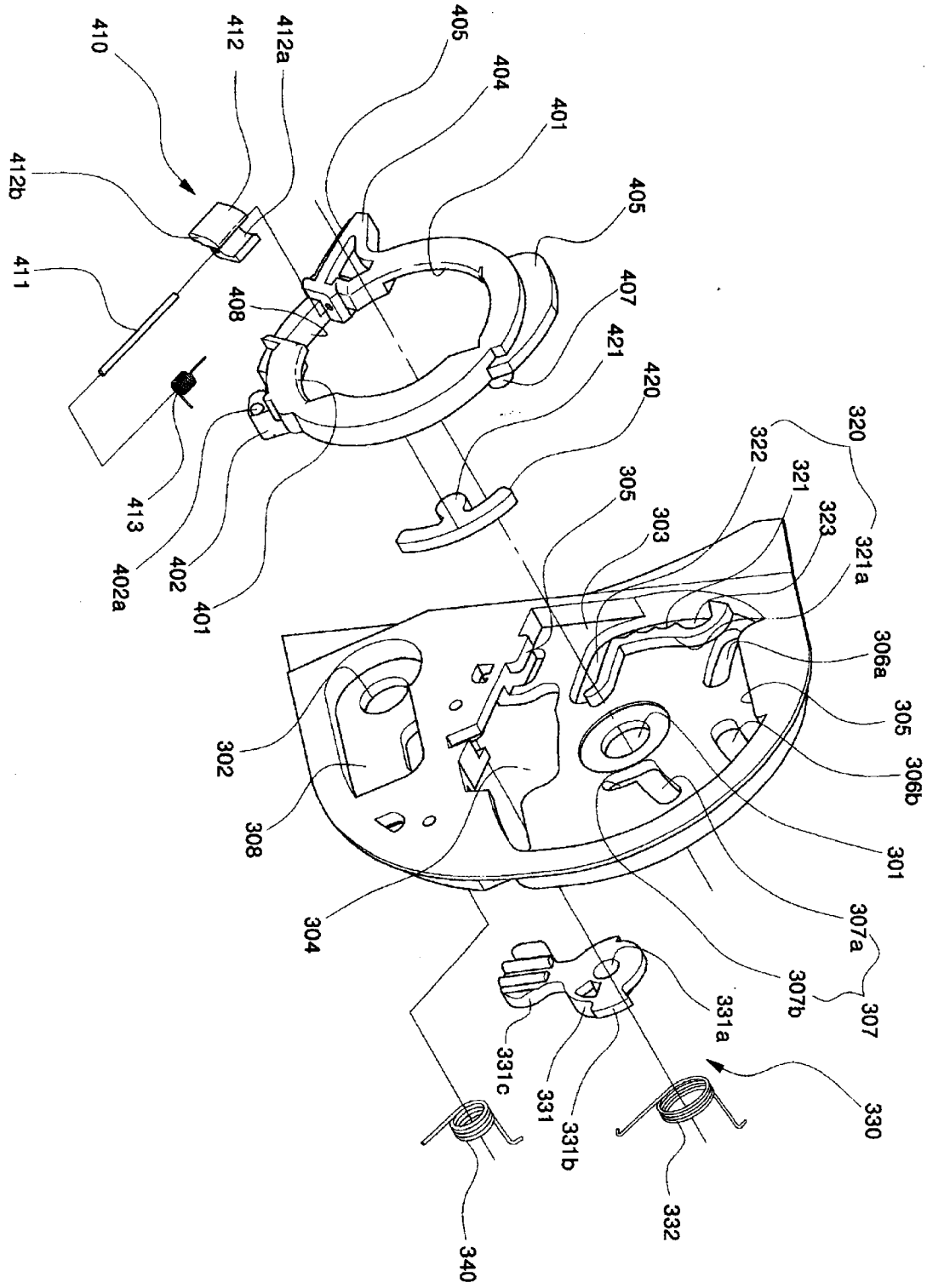

【Fig.5】
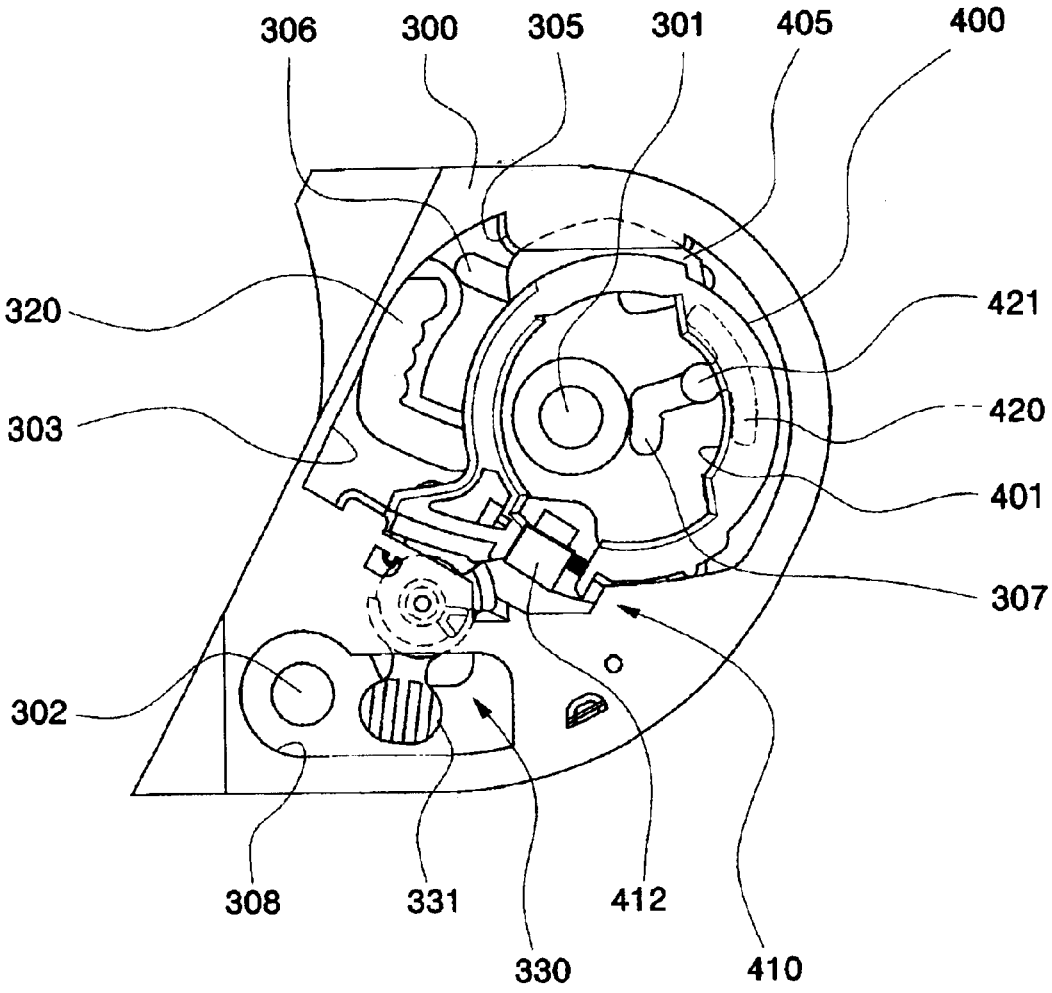

【Fig.6】
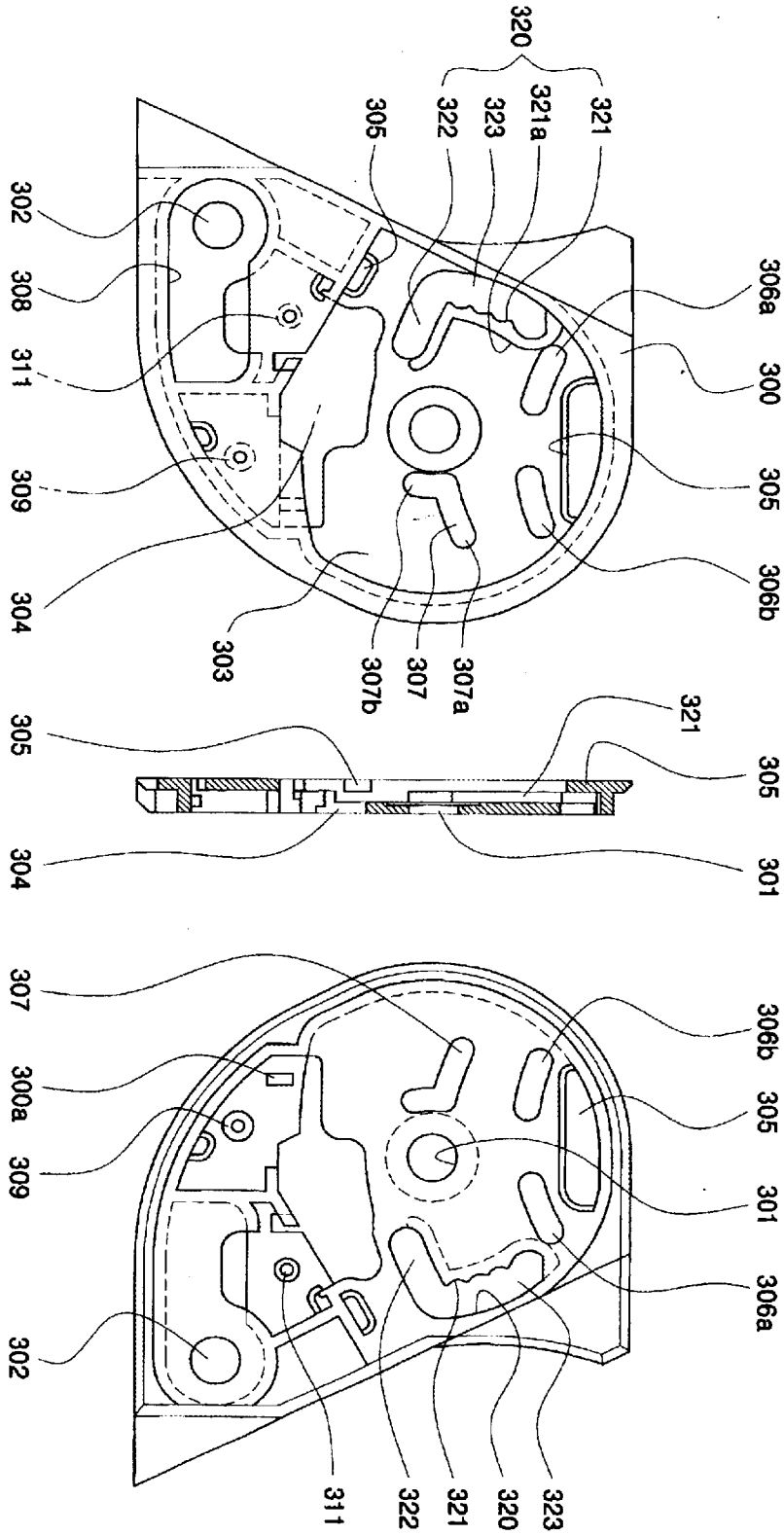

【Fig.7】
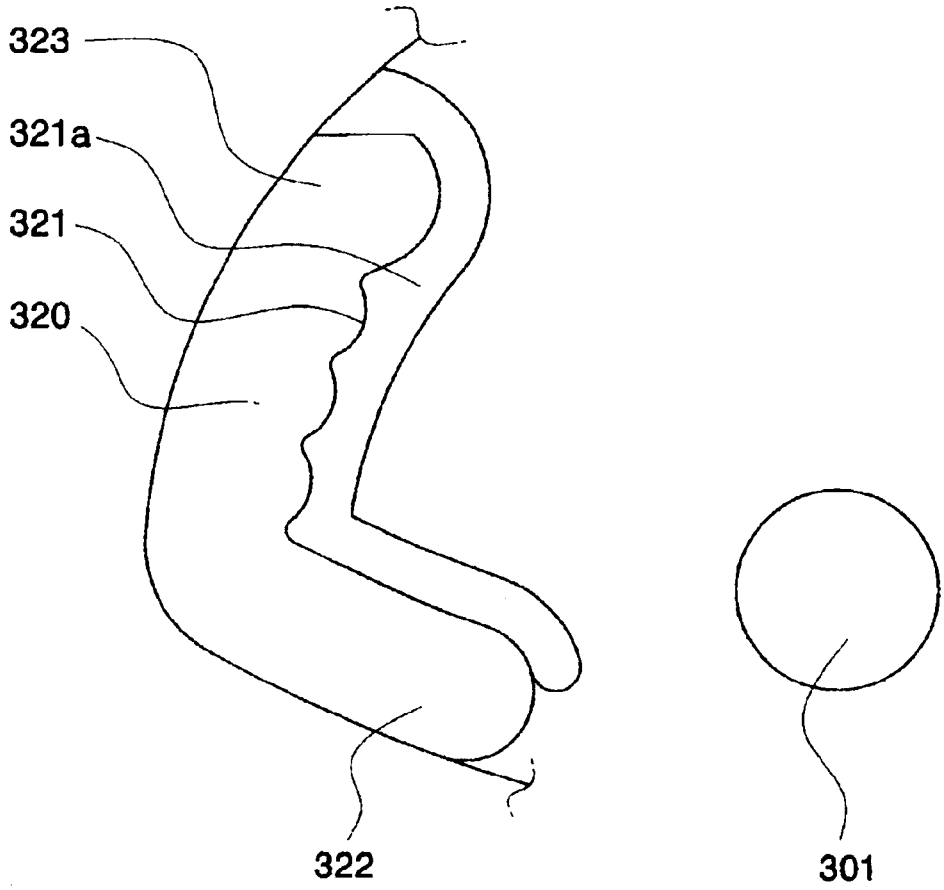

【Fig.8】
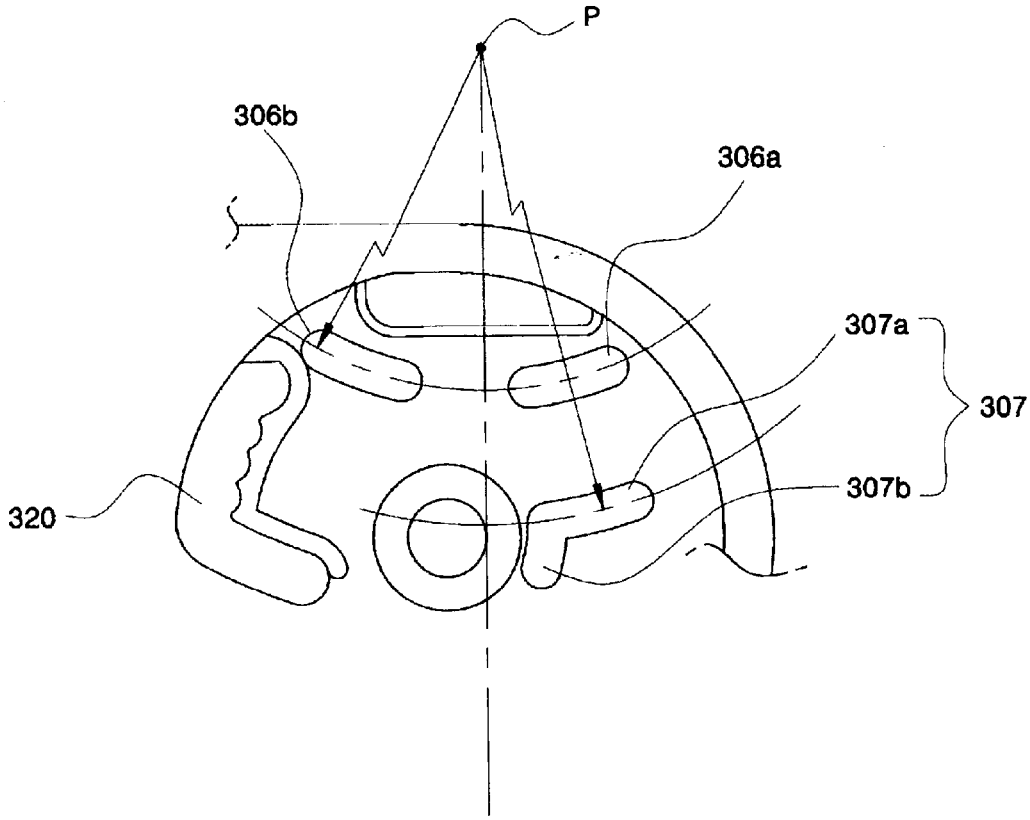

【Fig.9】
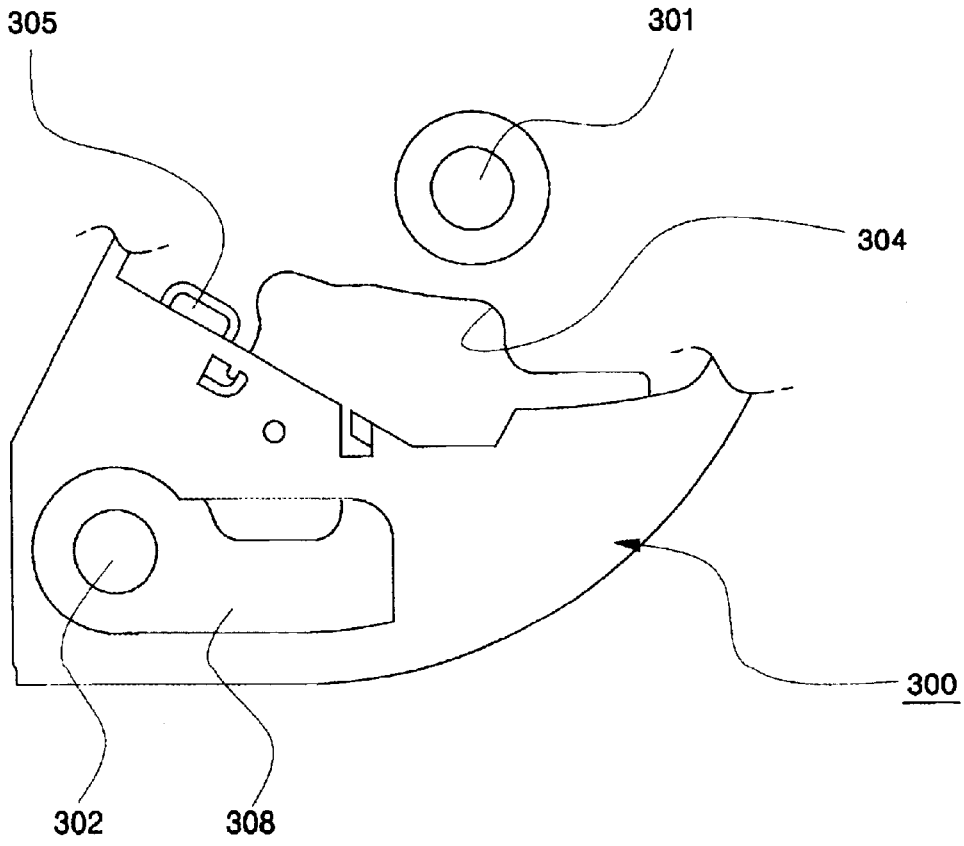

【Fig.10】
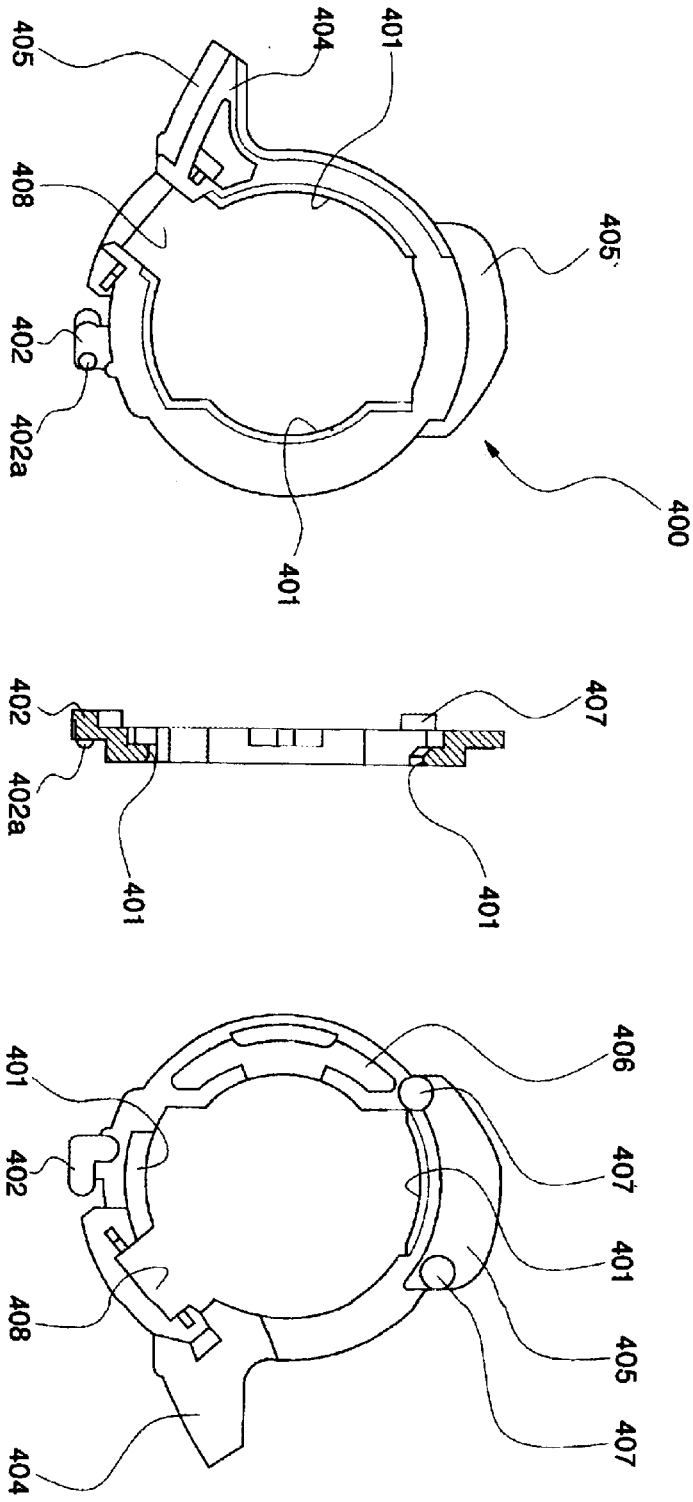

【Fig.11】
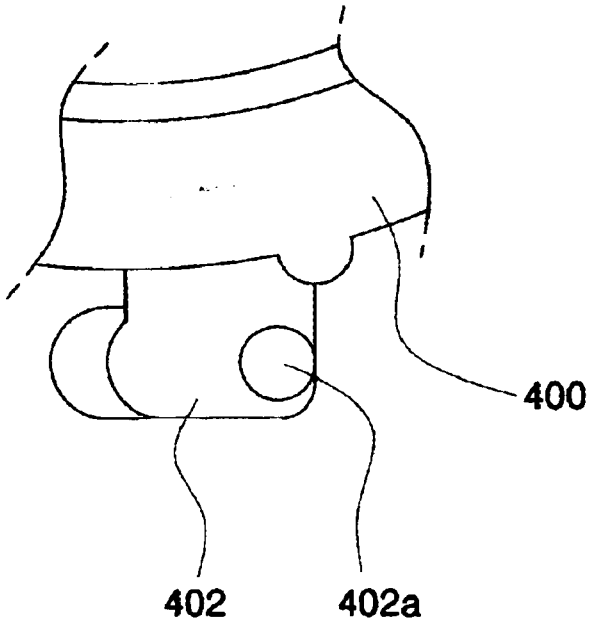
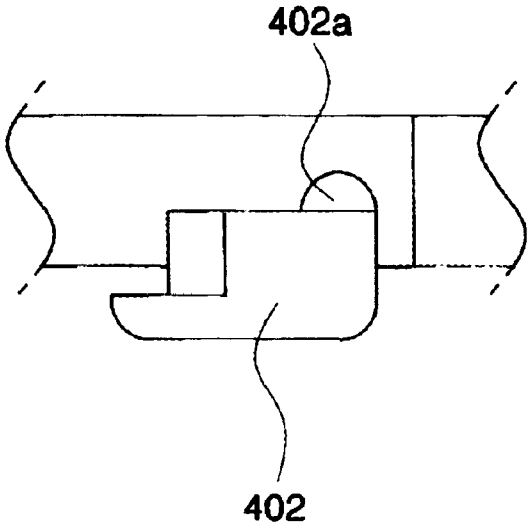

【Fig.12】
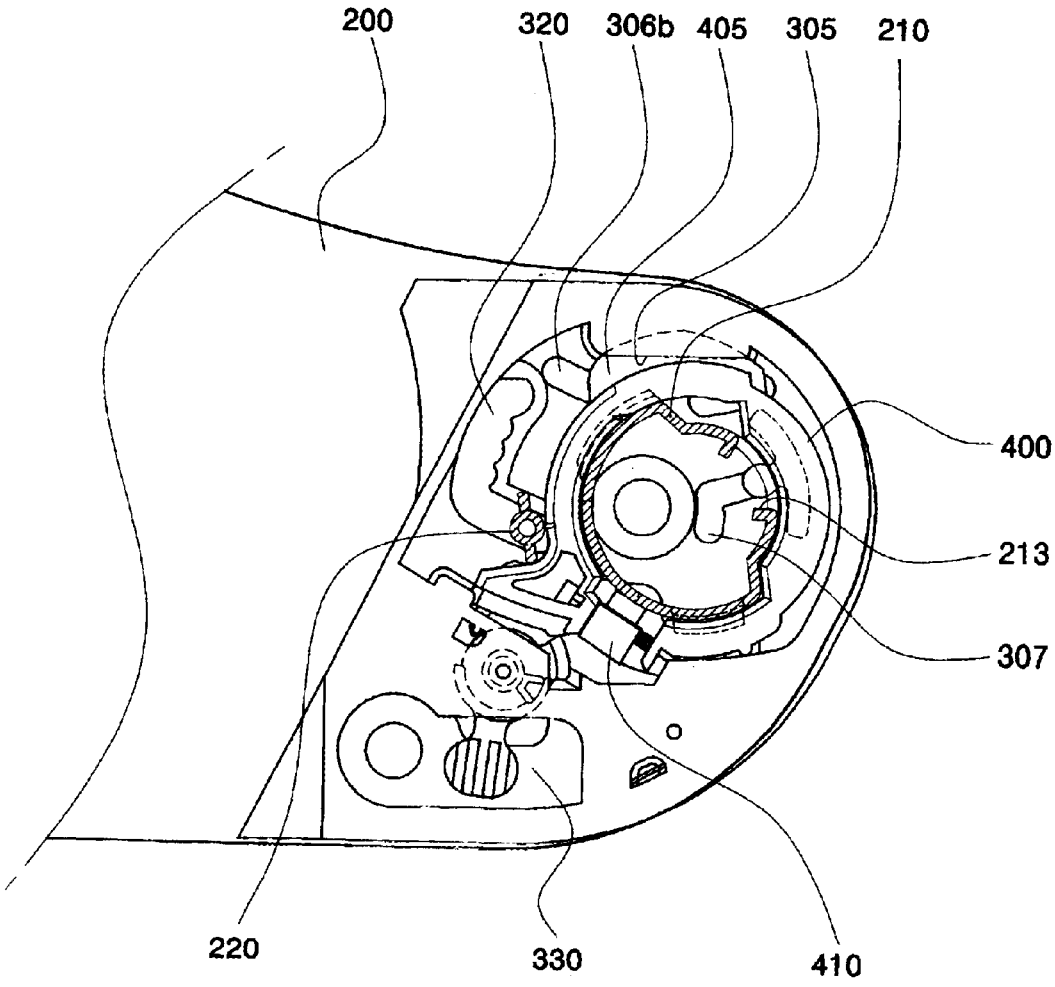

【Fig.13】
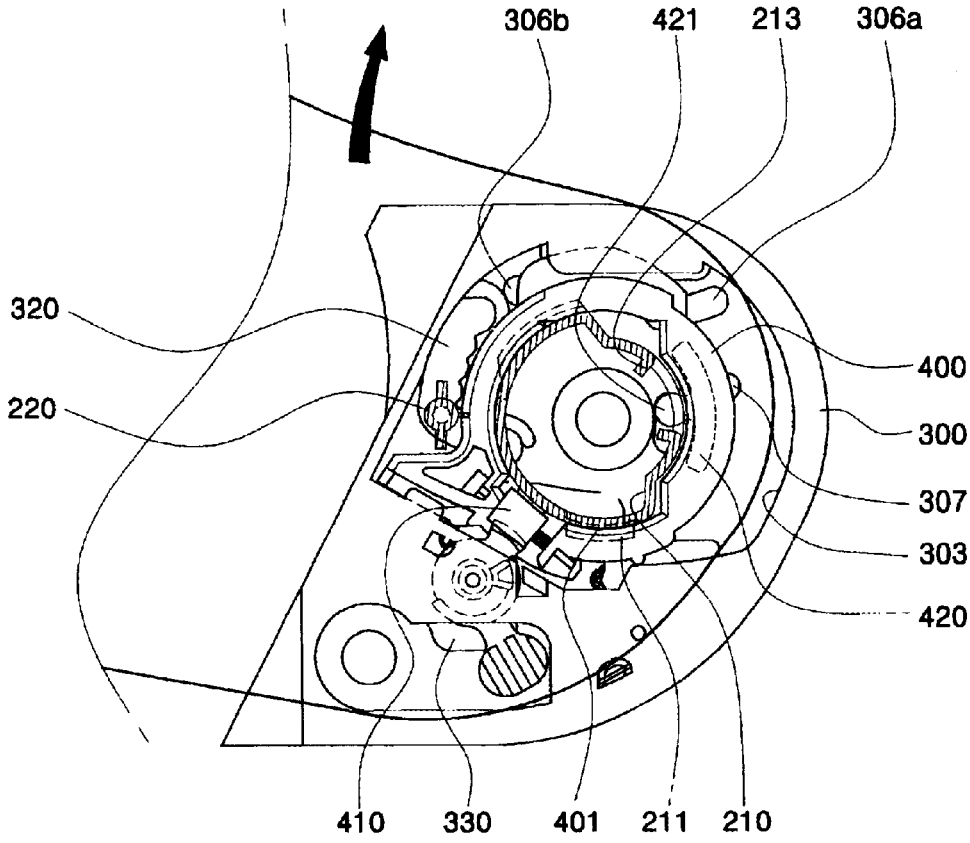

【Fig.14】
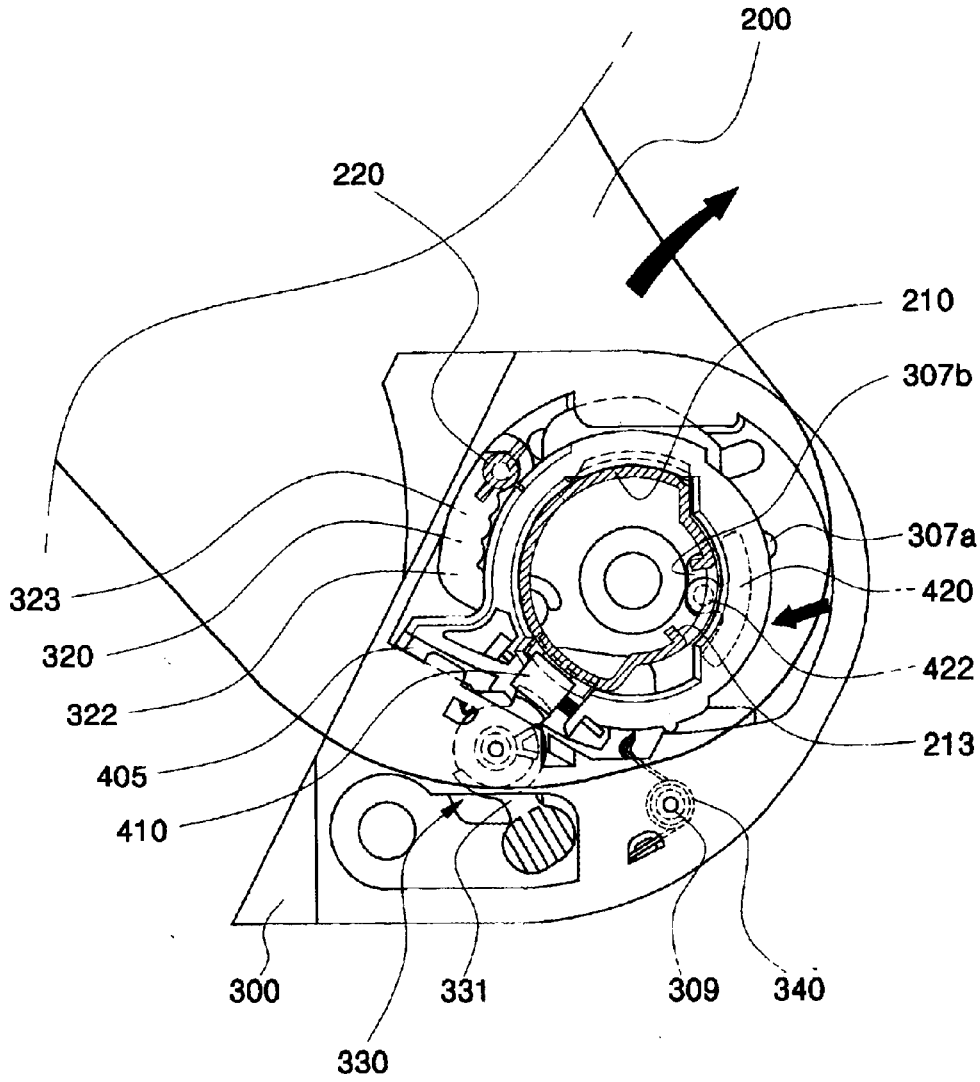

【Fig.15】
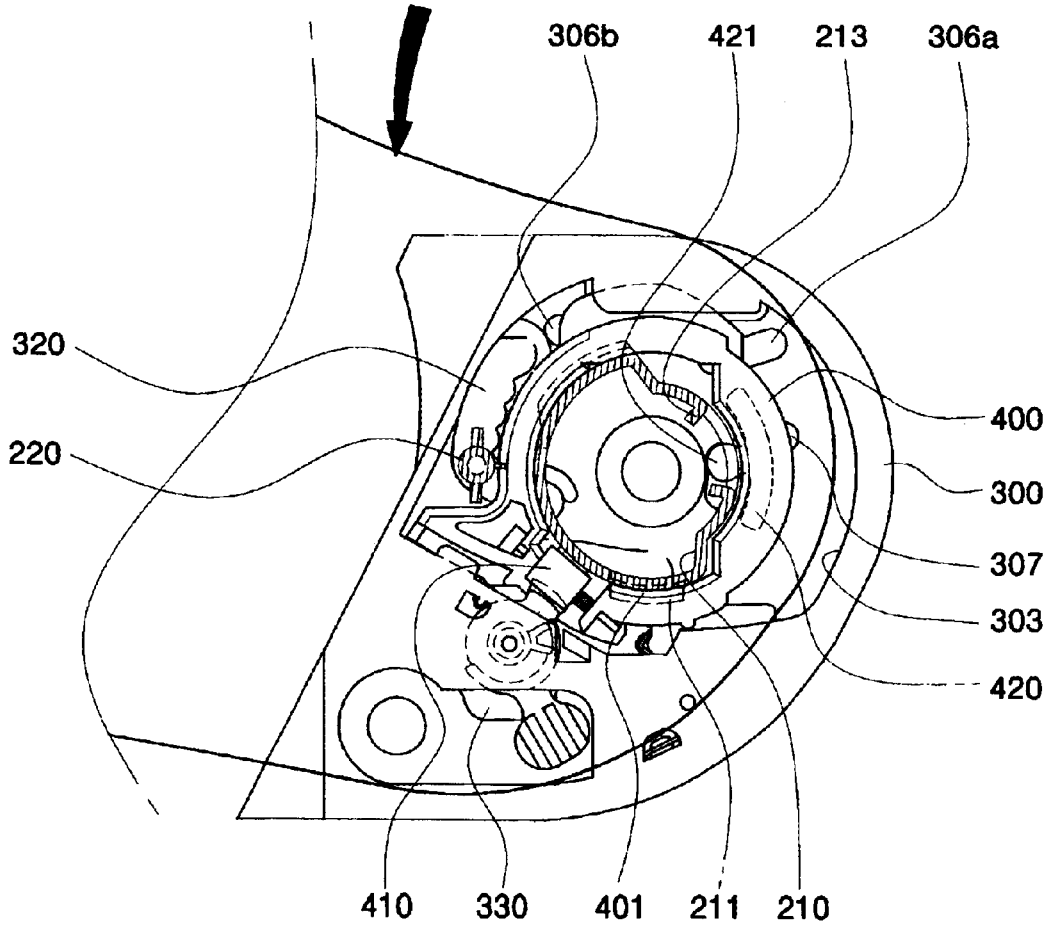

【Fig.16】
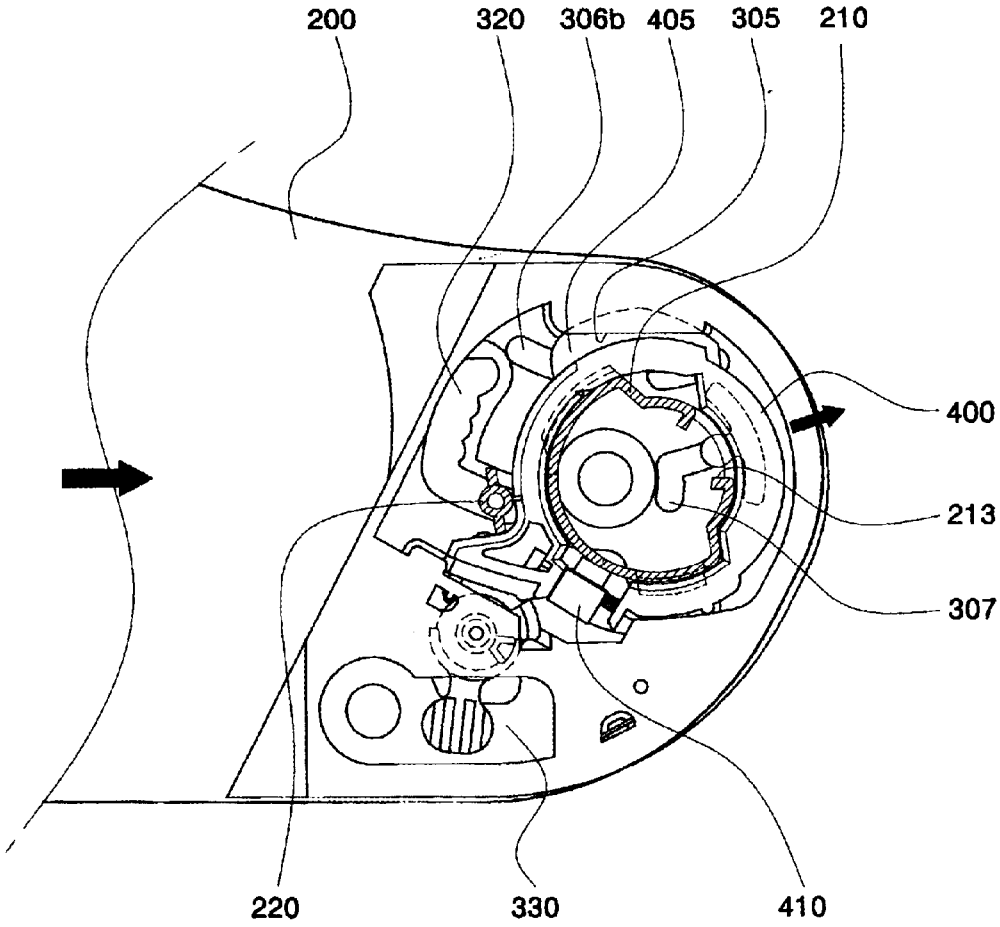

【Fig.17】
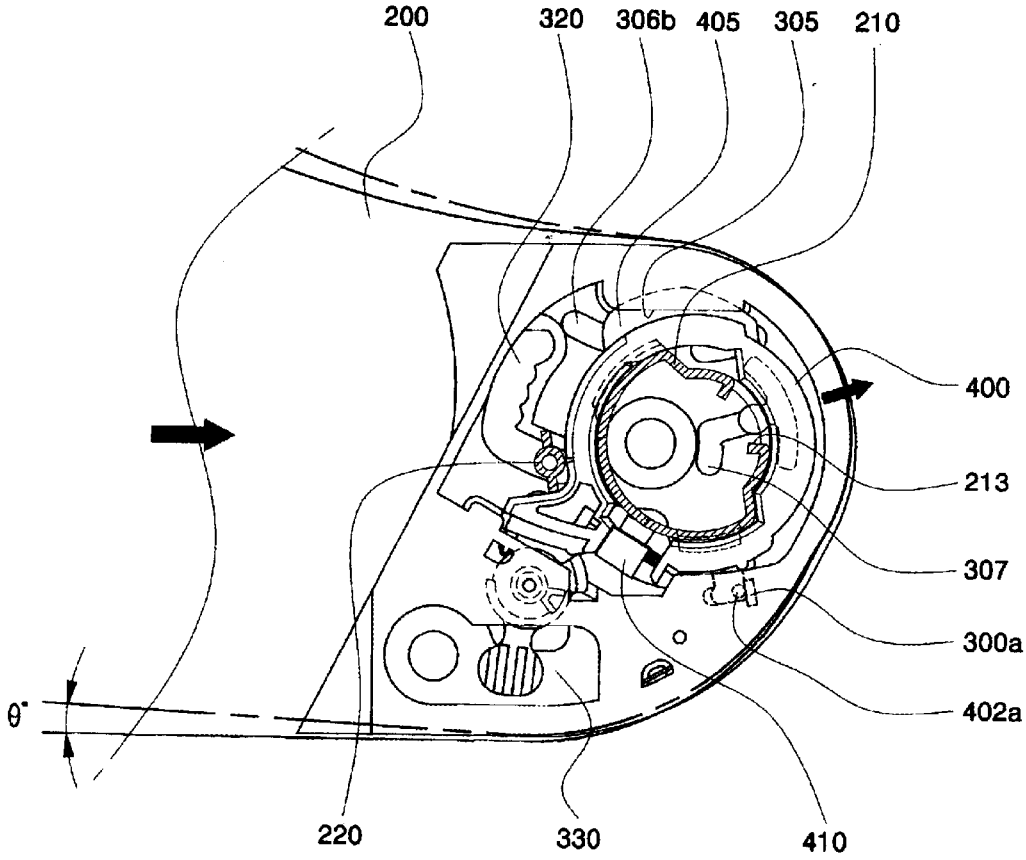

【Fig.18】
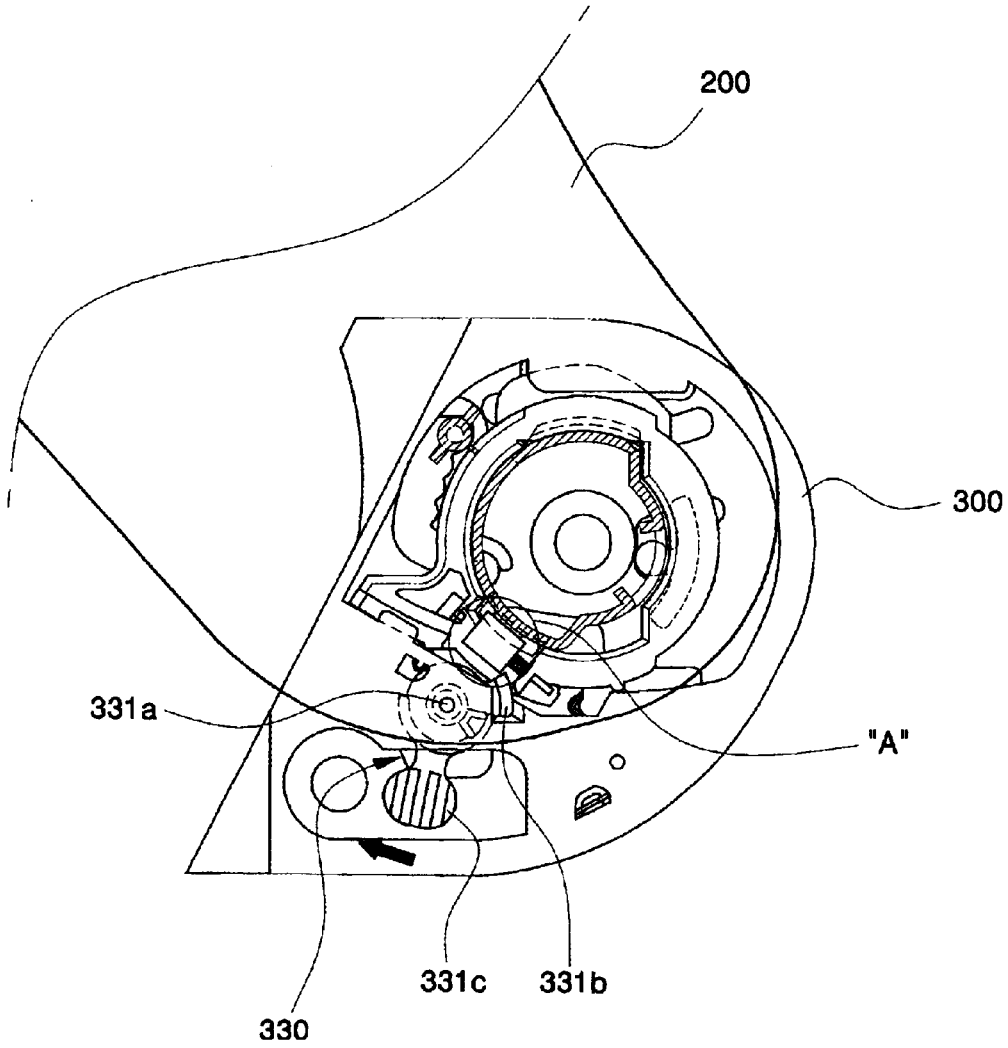

【Fig.19】
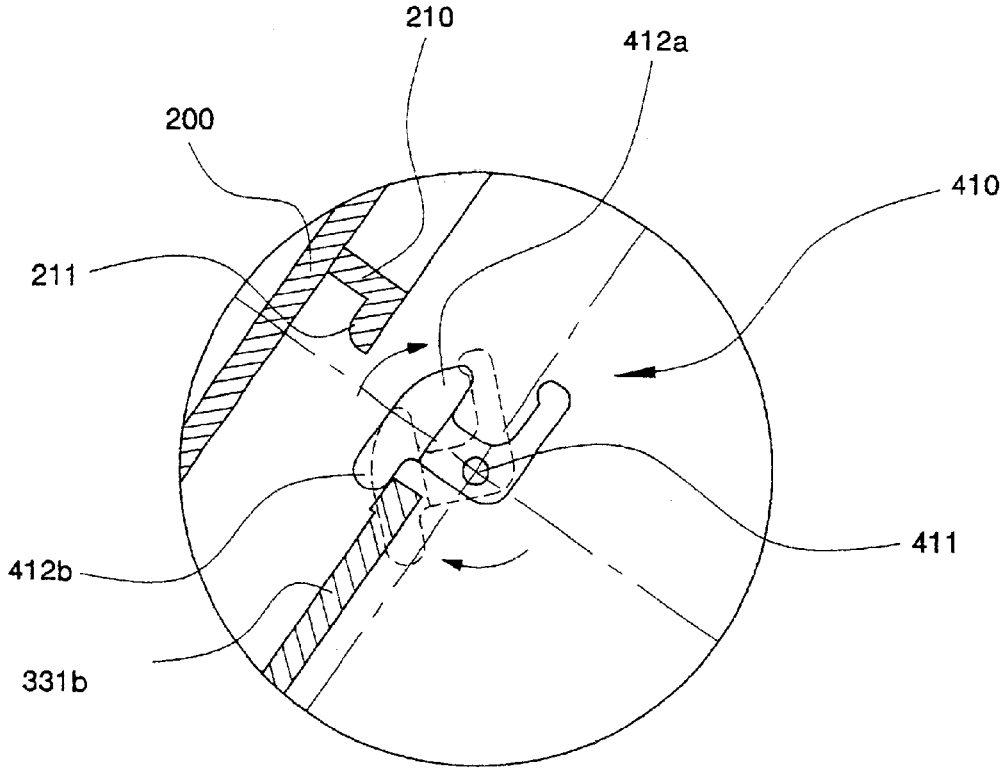
"A" Cross-sectional view

COUPLING APPARATUS FOR HELMET SHIELD

BACKGROUND OF THE INVENTION

1. Field of the Invention

The present invention relates to a shield coupling apparatus for implementing a good field of vision and protecting a user's eyes in a helmet which is designed to protect a user's head when riding a motorcycle, and in particular to a coupling apparatus for a helmet shield which is capable of preventing a helmet from being upwardly lifted up at a high speed driving of a motorcycle by implementing a slight backward movement of a helmet using a spring when a helmet shield is fully closed in order for a shield to closely contact with a front surface of a helmet, implementing an easier putting-on and putting-off operation of a shield by improving a shield coupling apparatus and maintaining a slightly open state of a shield for thereby preventing a steaming-up phenomenon in the interior of a helmet.

2. Description of the Background Art

Generally, when riding a two-wheeled vehicle such as a motorcycle, etc., a heat protection helmet must be put on for protecting a user's head. The above helmet includes a shield for implementing a certain field of vision and protecting a user's eyes.

The above shield of a helmet is coupled to a helmet using a coupling apparatus having hinge portions at both sides for thereby implementing an upward and downward movement of the same. Recently, various helmets having more free upward and downward movements and easier putting-on and putting-off operations are developed.

For an example, according to the Korean Patent Application No. 1999-32362, the Korean Patent Application No. 2000-6348, and the Korean Utility model No. 20-210272, the shield is designed to be tilted upwardly or downwardly. when the shield is tilted, the shield may be stopped at multiple positions, so that a user can determine a tilting angle of the shield. In addition, in the above conventional helmets, the helmet is designed in order for the shield to be easily disassembled from the hinge portion.

However, since the conventional shield coupling apparatus is designed based on only the shield hinge function and the disassembling and assembling structure, the following disadvantages may occur.

Namely, when the shield is fully closed, a certain force is needed in order for the shield to be closely contacted with the helmet. However, in the above conventional helmets, since there is not a certain structure for providing the above. force, the entire portions of the shield may be vibrated or a certain part of the helmet may be slightly lifted-up due to air which collide with a front surface during the driving.

In addition, as shown in FIG. 1, in the case that the helmet includes a protection portion in a jaw portion, a steaming-up phenomenon may occur in an inner surface of the shield due to a user's breath. In this case, it is impossible to maintain a slightly open state of the shield for the purpose for preventing a steaming-up phenomenon.

SUMMARY OF THE INVENTION

Accordingly, it is an object of the present invention to provide a coupling apparatus for a helmet shield which overcomes the problems encountered in the conventional art.

It is another object of the present invention to provide a coupling apparatus for a helmet shield a coupling apparatus for a helmet shield which is capable of preventing a helmet from being upwardly lifted up at a high speed driving of a motorcycle by implementing a slight backward movement of a helmet using a spring when a helmet shield is fully closed in order for a shield to closely contact with a front surface of a helmet, implementing an easier putting-on and putting-off operation of a shield by improving a shield coupling apparatus and maintaining a slightly open state of a shield. for thereby preventing a steaming-up phenomenon in the interior of a helmet.

In order to achieve the above objects, there is provided a coupling apparatus for a helmet shield which includes a helmet, and a shield for closing and opening a front portion of the helmet, comprising a shield which includes left and right protruded inner portion, a curved rim protrusion, a cam shaped shaft portion having an engaging shaft flange at both sides of the rim protrusion, and a guide pin shaft protruded from one side of the same, a movable shaft member which includes a shaft flange guide shoulder portion inserted into the shaft flange of the shield and connected to be rotatable and a locking unit for preventing an escape of the shaft flange, a base member which includes upper and lower escape prevention shoulder portions which are slide-movable by assembling upper and lower escape prevention flanges formed in an outer circumferential surface of the movable shaft member, a concave portion and unlocking member operation space in one side surface, a guide inducing groove for the pin shaft installed in a bottom side of the concave portion, and an unlocking unit for unlocking the locking unit, and a movable shaft member spring which is assembled to the back surface of the base member and includes one end engaged to a spring engaging ring of the movable shaft member and the other end supported by the base member for thereby returning the movable shaft member, wherein the cam shaped shaft portion of the shield is rotatable in the movable shaft member, and the movable shaft member is slide-movable in the concave portion of the base member in the forward and backward direction.

BRIEF DESCRIPTION OF THE DRAWINGS

The present invention will become better understood with reference to the accompanying drawings which are given only by way of illustration and thus are not limitative of the present invention, wherein;

FIG. 1 is a side view illustrating an assembled state of a helmet and a shield according to the present invention;

FIG. 2 is a side view illustrating a disassembled state of a base member and a shield according to the present invention;

FIG. 3 is a disassembled perspective view illustrating important elements according to the present invention;

FIG. 4 is a perspective view when seeing a helmet in a direction of a bottom side of FIG. 3;

FIG. 5 is a side view illustrating an assembled state of a coupling apparatus for a helmet shield the present invention;

FIG. 6 is a view illustrating the construction of a base member according to the present invention;

FIG. 7 is a view illustrating a guide inducing groove of a base member according to the present invention;

FIG. 8 is a detailed view illustrating each guide groove of a base member according to the present invention;

FIG. 9 is a detailed view illustrating an opening of a base member according to the present invention;

FIG. 10 is a view illustrating a movable shaft member according to the present invention;

FIG. 11 is a detailed view illustrating a spring engaging ring of a movable shaft member according to the present invention;

FIG. 12 is a side view illustrating a state that a shield is closed according to the present invention;

FIG. 13 is a side view illustrating a state that a shield is being opened according to the present invention;

FIG. 14 is a side view illustrating a state that a shield is fully opened according to the present invention;

FIG. 15 is a side view illustrating a state that a shield is being closed according to the present invention;

FIG. 16 is a side view illustrating a state that a shield is fully closed according to the present invention;

FIG. 17 is a side view illustrating a state that a shield is opened at a certain angle according to the present invention;

FIG. 18 is a side view illustrating a state that a shield is disassembled according to the present invention; and FIG. 19 is a cross-sectional view illustrating an operation state of a locking unit when disassembling a shield according to the present invention.

DETAILED DESCRIPTION OF THE PREFERRED EMBODIMENTS

The preferred embodiments of a coupling apparatus for a helmet shield according to the present invention will be explained with reference to the accompanying drawings.

FIG. 1 is a side view illustrating ah assembled state of a helmet and a shield according to the present invention, and FIG. 2 is a side view illustrating a disassembled state of a base member and a shield according to the present invention.

In addition, FIG. 3 is a perspective view illustrating important elements of a coupling apparatus for a helmet shield according to the present invention, and FIG. 4 is a perspective view when seeing the construction of FIG. 3 in a reverse direction according to the present invention.

The coupling apparatus for a helmet shield according to the present invention is symmetrically installed and operated at both sides of a helmet. In the following description, only one side of the above two sides of the helmet is described for a simplification because the other side is symmetrically the same as one side and operates in the same manner.

As shown therein, there are provided a shaft flange 211 and a pin shaft 220 of a shield, a base member 300 and a movable shaft member 400 which are attached to a body 100, and a locking unit 410 and an unlocking unit 330 which are provided in the above members.

As shown in FIG. 2, in the shield 200, a cam shaped shaft portion 210 and a pin shaft 220 are protruded from the inner side surfaces of both sides. The cam shaped shaft portion 210 includes a rim protrusion 212 formed of a larger semicircular portion and a smaller semicircular portion, an engaging shaft flange 211 protruded in both side directions from the larger semicircular portion of the rim protrusion, and a lead plate 213 which is inwardly formed from the smaller semicircular portion.

As shown in FIG. 6, the base member 300 attached to the body includes an upper center engaging screw hole 301, a lower center engaging screw hole 302, and an opening 304 formed between the upper center engaging screw hole 301 and the lower center engaging screw hole 302.

In addition, a concave portion 303 is formed in a surrounding portion of the engaging screw hole 301 formed in the center portion in the exposed side. An escape prevention shoulder portion 305 is formed in an inner diameter portion of the concave portion in an upper and lower symmetric structure. A plurality of movable shaft guide grooves 306*a* and 306*b* pass through the bottom of the concave portion and are formed in a surrounding portion of the engaging screw hole 301. An upside down L-shaped movable shaft guide groove is formed. The pin shaft 220 is inserted into the guide inducing groove 320 and is slide-moved. There is provided an unlocking member operation space 308 of the unlocking unit 330 formed below the concave portion 303.

In addition, in the other surface which is closely contacted with the body and is not exposed to the outside, there are provided a movable shaft member spring mounting portion 310 having a spring protrusion 309, a small angle open protrusion 300*a* formed in the bottom, and an unlocking member shaft protrusion 311.

At this time, as shown in FIG. 7, the-guide inducing groove 320 is formed of a slide movement guide portion 322, and a rotation guide portion 323 in a L-shape. A plurality of latch shoulder portions 321 are formed in an inner surface of the rotation guide portion 323, and the latch shoulder portions 321 each include a reinforcing rib 321*a*.

As shown in FIG. 8, the movable shaft guide groove 307 is formed of a horizontal portion 307*a* and a vertical portion 307*b* which are constructed in an upside down L-shape. An inward protrusion 422 is inserted into the vertical portion 307*b* for thereby preventing the movable shaft member 400 from being backwardly moved until the shield is disassembled and then assembled.

As shown in FIG. 10, the movable shaft member 400 assembled to the concave-portion 303 of the base member is formed in a ring shape having a tail portion 404. In the front surface, an upper side escape prevention flange 405 and a lower side escape prevention flange 405, of the tail portion 404 are formed in the upper and lower circumferential portions. In the back surface, a plurality of movable shaft guide protrusions 407 are formed in the upper side and are constructed to be inserted into the movable shaft guide grooves 306*a* and 306*b* of the base member 300. A movable protrusion member mounting portion 406 is formed in one side of the same, and a movable protrusion member 420 having a protrusion head 421 and an inward protrusion 422 is provided. The inward protrusion 422 is inserted into the upside down L-shaped movable shaft guide groove 307.

As shown in FIG. 11, the spring engaging ring 402 is formed for thereby elastically supporting the movable shaft member spring 340. A stopper protrusion 402*a* is formed in-the back surface of the spring engaging ring 402. A locking unit 410 is formed in the concave groove portion by removing a part of the inner diameter portion of the lower portion of the same.

As shown in FIGS. 3, and 4, the locking unit 410 locks the shaft flange 211 of the shield 200 which is inserted into an inner diameter portion of the movable shaft member and is rotated and is formed of a locking shaft 411 installed in the concave groove portion, a locking spring 413 for elastically supporting the locking shaft, and an eject plate 412 which is engaged to the locking shaft 411 together with the locking spring and is formed of a channel shaped locking shoulder portion 412*a* formed in the inward direction and an unlocking touch portion 412*b* formed in the opposite outward direction.

As shown in FIGS. 3 and 4, the unlocking unit 330 is inserted onto the locking shaft 411 and locks or unlocks the eject plate 412 which is rotated in the width wise direction of the base member. The unlocking unit 330 is formed of an unlocking member shaft protrusion 311 formed in the back surface below the opening 304 of the base member 300, an unlocking member 331 which is formed of an unlocking shaft hole 331 a engaged to the shaft protrusion 311, an unlocking operation plate 331*b* protruded in an upward direction, and an unlocking handle 331*c* protruded in a downward direction, and an unlocking member spring 332 which is engaged to the unlocking member shaft protrusion 311 and returns the unlocking member 331 in a certain direction.

The operation of the present invention will be described with reference to the accompanying drawings.

First as shown in FIG. 12, the operation will be described based on the assumption that the unlocking unit 330 is assembled to the base member 300, and the movable shaft member 400 and the locking unit 410 are assembled to the base member 300.

In addition, the operations will be described with respect to the upward and downward direction rotation operations of the shield 200 and the detaching operation of the shield 200.

FIG. 12 is a side view illustrating a state that the shield is closed according to the present invention. The operation of the upward and downward direction rotation of the shield will be described.

In the above state, the movable shaft member 400 remains a backwardly moved state in the concave portion 303 of the base member 300 (in the drawing, in the right portion). The movable shaft guide protrusions 407 which are protruded in the direction of the back surface are positioned in the backward portions in the movable. shaft guide grooves 306*a* and 306*b* of the base member 300.

In the state that the movable protrusion member 420 is positioned in the upward portion in the movable protrusion member mounting portion 406 of the movable shaft member 400, the. inward protrusion 422 is positioned in the backward portion in the movable shaft guide groove 307.

The cam shaped shaft portion 210 of the shield 200 is assembled to an inner diameter portion of the movable shaft member 400, and the shaft flange 211 is engaged to the shaft flange guide shoulder portion 401 for thereby being not escaped therefrom, and the pin shaft 220 of the shield 200 is positioned in the section of the slide movement guide portion 322 of the guide inducing groove 320.

In the above state, when a user of a helmet lifts up the shield 200, the shield 200 is slightly forwardly moved in a first stage and is upwardly rotated in a second stage.

Namely, when a certain force is applied to the shield 200 for lifting up the same, the above force is transferred to the movable shaft member 400 through the cam shaped shaft portion 210. The movable shaft guide protrusions 407 of the movable shaft member 400 are moved along the movable shaft guide grooves 306*a* and 306*b*. Since the movable shaft guide grooves 306*a* and 306*b* are formed in a circular shape with respect to a certain center point P and are horizontal, the movable shaft member 400 is horizontally moved in a forward direction as shown in FIG. 12.

Therefore, the shield 200 is forwardly moved based on the movement of the movable shaft member 400. Thereafter, as shown in FIG. 13, the movable protrusion member 420 is moved from the horizontal portion 307*a* of the upside down L-shaped movable shaft guide groove 307 to the vertical portion 307*b*, and the pin shaft 220 of the shield 200 is moved from the slide movement guide portion 322 of the guide inducing groove 320 to the rotation guide portion 323, so that the forward movement of the movable shaft member 400 is stopped. The cam shaped shaft portion 210 is upwardly rotated along the inner diameter portion of the movable shaft member 400.

Since the movable shaft member spring 340 assembled to the spring protrusion 309 of the base member 300 is engaged to the spring engaging ring 402 of the movable shaft member 400, a certain force is applied in order for the shield 200 including the movable shaft member 400 to return to their original positions. When a force is continuously applied for lifting up the shield 200, the pin shaft 220 is caught by the latch shoulder portion 321 having a multiple-stage circular groove in the rotation guide portion 323 of the guide inducing groove 320 and is upwardly moved. At the same time, the inward protrusion 422 of the movable protrusion member 420 is moved to the vertical portion 307*b* of the upside down L-shaped movable shaft guide groove 307.

Therefore, in the movable shaft member 400, a force for lifting up the shield is removed. Even when the force of the movable shaft member spring 340 is continuously applied, it is impossible to return its original position.

In addition, the pin shaft 220 of the shield 200 is caught by the latch shoulder portion 321 having a multiple-stage semicircular groove in the rotation guide portion 323 of the guide inducing groove 320, so that it is possible to stop the shield 200 at a certain desired position.

FIG. 14 shows the above described construction and operation according to the present invention.

On the contrary, when closing the shield 200, the shield 200 is manually lowered.

When the shield 200 is lowered, the cam shaped shaft portion 210 of the shield 200 is reverse-rotated along the inner diameter portion of the movable shaft member 400, and the pin shaft 220 is downwardly moved along the latch shoulder portion 321 of the guide inducing groove 320.

The lead plate 213 of the cam shaped shaft portion 210 moves the protrusion head 421 of the movable protrusion member 420 and upwardly moves the inward protrusion 422, which is protruded from the protrusion head in the opposite direction, in the vertical portion 307*b* of the movable shaft guide groove 307.

The rotation movement is performed until the pin shaft 220 moves to the rotation guide portion 323. When the pin shaft 220 is moved beyond the slide movement guide portion 322, the inward protrusion 422 of the movable protrusion member 420 is moved beyond the horizontal portion 307*a* through the vertical portion 307*b*.

In the above operation state, the shield 200 remains in a state that the shield 200 is fully downwardly moved to the opening portion of the helmet.

The pin shaft 220 of the shield 200 is moved beyond the slide movement guide portion 322 of the guide inducing groove 320, and the inward protrusion 422 of the movable protrusion member 420 is moved beyond the horizontal portion 307*a* through the vertical portion 307*b*. Therefore, in this state, there are not any obstacles in order for the movable shaft member 400 to be backwardly moved. Since the force of the movable shaft member spring 340. engaged to the spring protrusion 309 of the movable shaft member 400 is applied, the movable shaft member 400 including the cam shaped shaft portion 210 of the shield 200 is automatically backwardly moved.

When the movable shaft member 400 is backwardly moved by the movable shaft member spring 340, the construction of FIG. 16 is obtained. In this state, since the shield 200 is backwardly moved, the front portion is fully contacted with the opening of the helmet.

As shown in FIG. 17, the stopper protrusion 402*a* formed in the back surface of the spring engaging ring 402 of the movable shaft member 400 is slide-moved on the bottom of the spring mounting portion 310 of the base member 300. When the stopper protrusion 402*a* is caught by the small angle open protrusion 300*a* formed in the bottom of the spring mounting portion 310, since the shield remains opened at a certain angle(θ°), it is possible to preventing a steaming-up phenomenon in the inner surface of the shield.

When the operation for opening and closing the shield 200 is performed, the locking unit 410 also operates.

Namely, when the shaft flange 211 of the shield 200 is rotation-moved near a portion in which the eject plate 412 of the locking unit 410 is formed, since it passes in a state that the eject plate 412 is inserted between the channel shaped locking shoulder 412*a* of the eject plate 412, the shaft flange 211 is not escaped.

The unlocking member 331 of the unlocking unit 330 supports the eject plate 412 in such a manner that the shaft flange 211 passes between the channel shaped locking shoulder portion 412*a*.

Namely, since the unlocking operation plate 331*b* of the unlocking member 331 supports the unlocking touch portion 412*b* of the eject plate 412, when disassembling the shield 200, the eject plate 412 may be tilted by manually operating the unlocking touch portion 412*b*. The above operation will be described in detail when describing the shield disassembling operation.

FIG. 18 is a view illustrating a procedure that the shield 200 is disassembled and assembled to the movable shaft member 400.

In order to disassemble the shield 200, as shown in FIG. 14, the shield 200 is upwardly rotated and is fully opened.

When the shield 200 is fully opened, the lower portion of the base member 300 which is covered by the shield 200, namely, the unlocking member operation. space 308 is exposed. In the above state, the unlocking handle 331*c* of the unlocking member 331 engaged to the unlocking member shaft protrusion 311 is rotated in the direction of the arrow indicated in the drawing.

When the unlocking handle 331*c* is rotated, the opposite unlocking operation plate 331*b* which is supporting the eject plate 412 of the locking unit 410 is rotated, so that the unlocking touch portion 412*b* is released.

Therefore, as shown in FIG. 19, the eject plate 412 including the unlocking touch portion 412*b* is rotated downwardly from the locking shaft 411, and the channel-shaped unlocking touch portion 412*b* of the eject plate 412 which restricts the shaft flange 211 of the shield 200 is rotated by a force of the locking spring 413 for thereby releasing the restricted state of the shaft flange 211.

When one end of the shaft flange. 211 is in a free state,and the shield 200 is lifted up from the base member 300, the shaft flange 211 is easily separated from the shaft flange guide shoulder portion 401 of the movable shaft member 400 for thereby disassembling the entire constructions of the shield.

In addition, the shield 200 is assembled in a procedure reverse to the above assembling procedure.

Namely, the upper shaft flange 211 of the shield 200 is inserted into the upper shaft flange guide shoulder portion 401 in the inner diameter portion of the movable shaft member 400, and the lower shaft flange portion slightly presses the upper portion of the eject plate 412. Therefore, the shaft flange 211 is inserted between the channel-shaped unlocking touch portion 412*b*. In this state, when the unlocking member 331 of the unlocking unit 330 is rotated to its original position, the unlocking operation plate 331*b* of the unlocking member 331 is moved into the lower portion of the unlocking touch portion 412*b* of the eject plate 412, so that the eject plate 412 is not rotated.

Since the shaft flange 211 of the shield 200 is positioned in a lower portion of the shaft flange. guide shoulder portion 401 of the movable shaft member 400, it is not separated, so that all portions of the shield 200 is rotated in the upward and downward directions.

As described above, in the present invention, a concave portion is formed in the base member which is fixedly attached to both sides of the helmet body, and the movable shaft member is forwardly and backwardly movable within a range of the concave portion. In this state, the cam shaped shaft portion of the shield is rotatable, and the spring is installed. Therefore, when the shield is fully closed, all portions of the shield including the movable shaft member is slightly backwardly moved by the spring at the moment when the downward rotation is stopped, so that the shield is closely contacted with the front surface of the helmet. Therefore, it is possible to implement a stable running operation even at a high speed running operation without vibration and noise.

In addition, since the locking unit and unlocking unit are organically engaged each other, it is easy to assemble and disassemble the shield which is rotatable on the movable shaft member.

In addition, in the present invention, since it is possible to maintain a slightly opened state of the shield in a state that the shield is not fully closed, it is possible to prevent a steaming-up phenomenon.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A coupling apparatus for a helmet shield which includes a helmet, and a shield for closing and opening a front portion of the helmet, comprising:

a shield which includes left and right protruded inner portion, a curved rim protrusion, a cam shaped shaft portion having an engaging shaft flange at both sides of the rim protrusion, and a guide pin shaft protruded from one side of the same;

a movable shaft member which includes a shaft flange guide shoulder portion inserted into the shaft flange of the shield and connected to be rotatable and a locking means for preventing an escape of the shaft flange;

a base member which includes upper and lower, escape prevention shoulder portions which are slide-movable by assembling upper and lower escape prevention flanges formed in an outer circumferential surface of the movable shaft member, a concave portion and unlocking member operation space in one side surface, a guide inducing groove for the pin shaft installed in a bottom side of the concave portion, and an unlocking means for unlocking the locking means; and a movable shaft member spring which is assembled to a back surface of the base member and includes one end engaged to a spring engaging ring of the movable shaft member and the other end supported by the base member for thereby returning the movable shaft member, wherein the cam shaped shaft portion of the shield is rotatable in the movable shaft member, and the movable shaft member is slide-movable in the concave portion of the base member in a forward and backward direction.

2. The apparatus of claim 1, wherein said movable shaft member is formed in a ring shape having a tail portion, and an upward direction escape prevention flange and a downward direction escape prevention flange of the tail are formed in the upper and lower circumferential surfaces in the side of the surface, and a plurality of movable shaft guide protrusions are formed in the upper side in a back surface and are inserted into movable shaft guide grooves in the base member, and a movable protrusion member mounting portion is formed in one side, and a movable protrusion member having a protrusion head and inward protrusion is installed, and the inward protrusion is inserted into an upside down L-shaped movable shaft guide groove, and a spring engaging ring is formed in the lower portion of the same for being elastically supported by the movable shaft member spring, and said locking means installed in the lower portion of the same.

3. The apparatus of claim 1, wherein said base member includes:

a first engaging screw hole formed in an upper center portion of the same;

a second engaging screw hole formed in a lower center portion;

an opening formed between the first and second engaging screw holes;

said concave portion formed in a surrounding portion of the first engaging screw hole formed in the center portion of the surface;

said upper and lower escape prevention shoulder portions formed in an inner diameter portion of the concave portion;

a plurality of movable shaft guide grooves which pass through the bottom of the concave portion and are formed in a surrounding portion of the first engaging screw hole;

an upside down L-shaped movable shaft guide groove;

an unlocking member operation space of the unlocking means formed in a lower portion of the concave portion;

a movable shaft member spring mounting portion having a spring protrusion in the back surface; and an unlocking member. shaft protrusion.

4. The apparatus of either claim 1 or claim 2, wherein said locking means includes:

a groove formed by removing a part of an inner diameter portion of the movable shaft member;

a locking shaft installed in the groove;

a locking spring which is elastically supported by the locking shaft; and a shaft flange eject plate having a channel-shaped locking shoulder portion which is shaft-engaged to the locking shaft together with the locking spring in an inward direction and an unlocking touch portion formed in an outward direction, for thereby connecting or disconnecting the shaft flange of the shield in which the movable shaft member is inserted into the inner diameter portion.

5. The apparatus of either claim 1 or claim 3, wherein said unlocking means includes:

an unlocking member shaft protrusion formed in the back surface in a lower portion of the opening of the base member;

an unlocking member which is shaft-engaged to the shaft protrusion and is formed of an unlocking shaft hole, an unlocking operation plate which is upwardly protruded, and an unlocking handle which is downwardly protruded; and an unlocking member spring which is shaft-engaged to the unlocking member shaft protrusion for returning the unlocking member in one direction, wherein the unlocking operation plate of the unlocking member connects or disconnects the shaft flange eject plate of the locking means.

6. The apparatus of claim 3, wherein said guide inducing groove includes a slide movement guide portion and a rotation guide portion, and a plurality of latch shoulder portions are formed in an inner surface of the rotation guide portion, and each latch shoulder portion includes a reinforcing rib.

7. The apparatus of claim 6, wherein said movable shaft guide groove is formed of a horizontal portion and a vertical portion which are formed in an upside down L-shape in such a manner that an inward protrusion of a movable protrusion member of the movable shaft member is inserted into the vertical portion for thereby preventing an escape of the movable shaft member.

8. The apparatus of claim 1, wherein said cam shaped shaft portion of the shield includes a pair of lead plates for leading a protrusion head of a movable protrusion member of the movable shaft member in the other side of the pin shaft.

9. The apparatus of claim 7, wherein the slide movement guide portion of the guide inducing groove, the horizontal portion of the movable shaft guide groove and the movable shaft guide groove of the base member are formed in a circular elongated hole shape, and the centers(P) of the circular holes are gathered at a certain position.

10. The apparatus of claim 1, wherein in said base member, a small angle open protrusion is formed in the bottom of a spring mounting portion, and a stopper protrusion is formed in the back surface of the spring engaging ring of the movable shaft member, so that the shield is opened at an angle θ when the stopper protrusion is caught by the small angle protrusion.

* * * * *